US006501936B1

(12) United States Patent
Sato

(10) Patent No.: US 6,501,936 B1
(45) Date of Patent: Dec. 31, 2002

(54) HEATING MECHANISM FOR USE IN IMAGE FORMING APPARATUS

(75) Inventor: Yoji Sato, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/972,909

(22) Filed: Oct. 10, 2001

(51) Int. Cl.[7] ..... G03G 15/20

(52) U.S. Cl. ..... 399/329; 198/840; 219/216; 399/320; 399/325

(58) Field of Search ..... 399/329, 328, 399/324, 325, 162, 165, 320; 242/410; 219/216; 198/804

(56) References Cited

U.S. PATENT DOCUMENTS 5,666,623 A * 9/1997 Yamada et al. ..... 399/325 X
5,778,294 A * 7/1998 Hiraoka et al. ..... 399/329
6,002,908 A * 12/1999 Hayashi et al. ..... 399/329 X
6,088,558 A * 7/2000 Yamada et al. ..... 399/329 X

FOREIGN PATENT DOCUMENTS

JP 10-20691 1/1998
JP 2000-338812 12/2000

* cited by examiner

*Primary Examiner*—Sophia S. Chen
(74) *Attorney, Agent, or Firm*—Foley & Lardner

(57) ABSTRACT

A heating mechanism includes a paper transmitting path for carrying a paper, a fixing roller provided on this paper transmitting path, a pressurizing roller disposed so as to oppose the fixing roller, a heating roller provided apart from the fixing roller for applying heat indirectly to the fixing roller, a belt which is wound around the heating roller and the fixing roller in order to transmit a rotation driving force from the fixing roller to the heating roller and thermal energy from the heating roller to the fixing roller and makes a contact with the other side face of the paper passing between the fixing roller and the pressurizing roller, and a pair of first restricting members disposed with a gap from both end faces of the heating roller to guard both sides of the belt on the heating roller thereby restricting a shifting motion of the belt in the width direction.

10 Claims, 5 Drawing Sheets

HEATING MECHANISM FOR USE IN IMAGE FORMING APPARATUS

BACKGROUND OF THE INVENTION

The present invention relates to an image forming apparatus such as electro-photographic copier and laser printer and more particularly to a heating mechanism for heating, melting and fixing a toner image onto paper.

A copier employs a so-called belt-type heating mechanism. Features of the belt-type heating mechanism is low power consumption, short warming-up time, oilless, separation characteristic and the like.

The belt-type heating mechanism comprises a fixing roller, a heating roller, a fixing belt (hereinafter referred to as a heat transferring belt) stretched between the fixing roller and the heating roller and a pressurizing roller disposed so as to oppose the fixing roller through the heat transferring belt. The heat transferring belt is heated by the heating roller and fed to the fixing roller. A so-called nip portion is formed between the heat transferring belt and the pressurizing roller and toner of a toner image is melted under a pressure, so that the toner image is fixed on the paper.

In such a conventional belt-type heating mechanism, the heat transferring belt shifts in a width direction during a rotation of the fixing roller/heating roller, so that the heat transferring belt deviates from an image forming range, and consequently, a non-fixed image region may be sometimes generated.

BRIEF SUMMARY OF THE INVENTION

Jpn. Pat. Appln. KOKAI Publication No. 2000-338812 (hereinafter referred to as a "preceding invention") has proposed installation of a restricting member onto a roller in order to restrict the deviation of the heat transferring belt. However, when in the belt-type heating mechanism of the preceding invention, a side portion of the belt makes a sliding contact with the restricting member, overload is applied to the belt, so that buckling or swelling occurs in the belt.

Thus, in the heating mechanism of the preceding invention, a release agent roller is pressed to the belt so as to coat the belt with the release agent (oil) and apply an additional tension thereto, thereby preventing the belt from being buckled or swollen. Further, in the heating mechanism of the preceding invention, the release agent roller is set up shorter than the width of the fixing belt in order to prevent the release agent from invading to a rear side of the belt.

However, if the belt width is larger than the release agent roller for applying a tension, a tension shortage region in which no sufficient tension is applied to the belt by the release agent roller is generated in a belt side portion. Particularly, in a portion on the side in which the belt shifts in the width direction, this tension shortage region is expanded. If the belt side short of tension makes a sliding contact with the restricting member, a local buckling or swelling (out-of-plane deformation) is generated in the belt and finally, the belt may be broken.

An object of the present invention is to provide a heating mechanism for use in an image forming apparatus capable of fixing a toner image on a paper stably without generating a buckling or swelling (out-of-plane deformation) in the belt.

To achieve the above object, according to an aspect of the present invention, there is provided a heating mechanism for use in an image forming apparatus, comprising: a paper transporting path for carrying a paper having a toner image; a fixing roller disposed in the paper transporting path so that it is rotated; a pressurizing roller disposed so as to oppose the fixing roller across the paper transporting path so that it contacts one side face of a paper carried on the paper transporting path, the pressurizing roller being rotated synchronously with the fixing roller for applying a pressure on the paper in cooperation with the fixing roller; a heating roller provided apart from the fixing roller for applying heat indirectly to the fixing roller; a heat transferring belt which is wound around the heating roller and the fixing roller in order to transmit a rotation driving force from the fixing roller to the heating roller and thermal energy from the heating roller to the fixing roller, makes a contact with the other side face of the paper passing between the fixing roller and the pressurizing roller, and melts toner on the toner image by heat to fix the toner image on the paper; and a pair of first restricting members disposed with a predetermined gap from both end faces of the heating roller to guard both sides of the heat transferring belt on the heating roller thereby restricting a shifting motion of the heat transferring belt in a width direction.

When the belt shifts in the width direction on the heating roller, a side portion of the belt is intercepted by the first restricting member so that a further shift in the width direction of the belt is restricted. Consequently, an excessive deviation of the belt from the heating roller is eliminated, so that a buckling or swelling (out-of-plane deformation) of the side portion of the belt is suppressed. In this case, the belt side is permitted to deviate from a peripheral face of the heating roller if it is slight. The reason is that unless the deviation amount of the belt side from the peripheral face of the heating roller exceeds a predetermined value, the tension applied to the belt side does not drop excessively, and therefore, substantially the belt side portion is not deformed. Therefore, even when the first restricting member is provided apart from an end face of the heating roller, if a gap G1 is set to a predetermined value or less, the buckling or swelling of the belt side portion is never generated. In this case, it is desirable that the gap G1 is not more than 1.5 mm.

The aforementioned first restricting member is desired to be disposed on the side in which the belt is fed from the heating roller. On the side (loose side) in which the belt is fed from the heating roller, the belt tension drops so that the buckling or swelling (out-of-plane deformation) is likely to occur on the belt side. Thus, by disposing the first restricting member on the belt loose side of the heating roller, the buckling or swelling (out-of-plane deformation) of the belt side can be prevented effectively.

Preferably, the heating mechanism in an image forming apparatus further comprises a pair of second restricting members disposed with a predetermined gap from both end faces of the fixing roller to guard both sides of the heat transferring belt. Because the second restricting member restricts a shift motion in the width direction of the belt on the fixing roller, synergistic effect is exerted with the restriction by the first restricting member on the heating roller side. That is, if the second restricting member is provided on the side of the fixing roller, the total length of the first and second restricting members which the belt side makes a sliding contact with is increased and therefore, a local stress concentration on the belt side is relaxed, so that the belt side is not buckled.

Preferably, the second restricting member is disposed on the side (loose side) in which the heat transferring belt is fed from said fixing roller. The belt tension drops on the side (loose side) in which the belt is fed from the fixing roller, so that the buckling or swelling (out-of-plane deformation) is likely to occur on the belt side. Thus, by disposing the second restricting member on the belt loose side of the fixing roller, the buckling or swelling (out-of-plane deformation) on the belt side can be prevented effectively.

Meanwhile, the width $L_B$ of the belt needs to be smaller than the length $L_H$ of the heating roller and the length of the fixing roller. The reason is that if the width $L_B$ of the belt is larger than the roller length, the belt side deviates from the peripheral rolling face peripheral circumferential surface of the heating roller or the fixing roller even when the belt does not shift in the width direction.

Preferably, the heating mechanism further comprises a release agent roller which coats the belt with release agent and is pressed on the entire width $L_B$ of the belt so as to apply a tension to the heat transferring belt. In this case, the length $L_{oil}$ of the release agent roller is substantially the same as a clearance between the pair of the first restricting members or a gap G2 between the end face of the release agent roller and the first restricting member is not more than 12 mm.

To apply a tension to the entire belt from the release agent roller, the length $L_{oil}$ of the release agent roller needs to be larger than the width $L_B$ of the heat transferring belt.

Preferably, the gap G2 in plan view from an end face of the release agent roller to the first restricting member is not more than 7 mm. If the gap G2 is not more than 7 mm, no deformation occurs in the belt side portion as shown in FIG. 9B. However, if the gap G2 is, for example, 12 mm, the belt side portion is deformed as shown in FIG. 9C, so that the buckling or swelling occurs and finally, the belt is broken. This reason is estimated to be that the tension applied from the release agent roller to the belt acts on a deviated belt side portion from the heating roller. Therefore, by providing with the release agent roller, it is possible to mount the first restricting member apart from the end face of the heating roller.

Meanwhile, it is permissible to employ only a tension roller which applies only a tension to the belt without coating the belt with the release agent, which substitutes the aforementioned release agent roller.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Hereinafter, the preferred embodiments of the present invention will be described with reference to the accompanying drawings.

Figure 1:
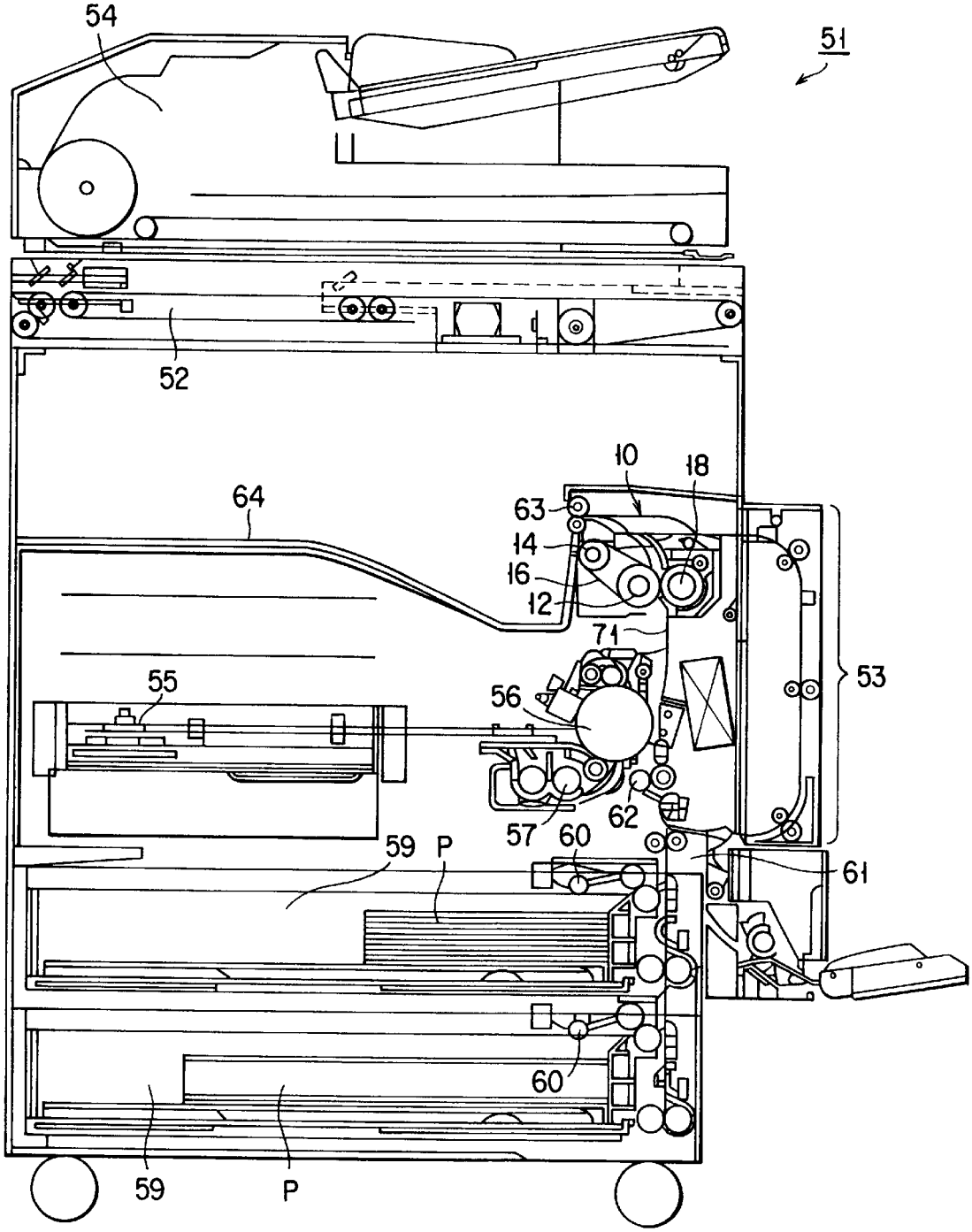
FIG. 1 is a perspective sectional view showing an entire internal structure of a copier.
Figure 2:
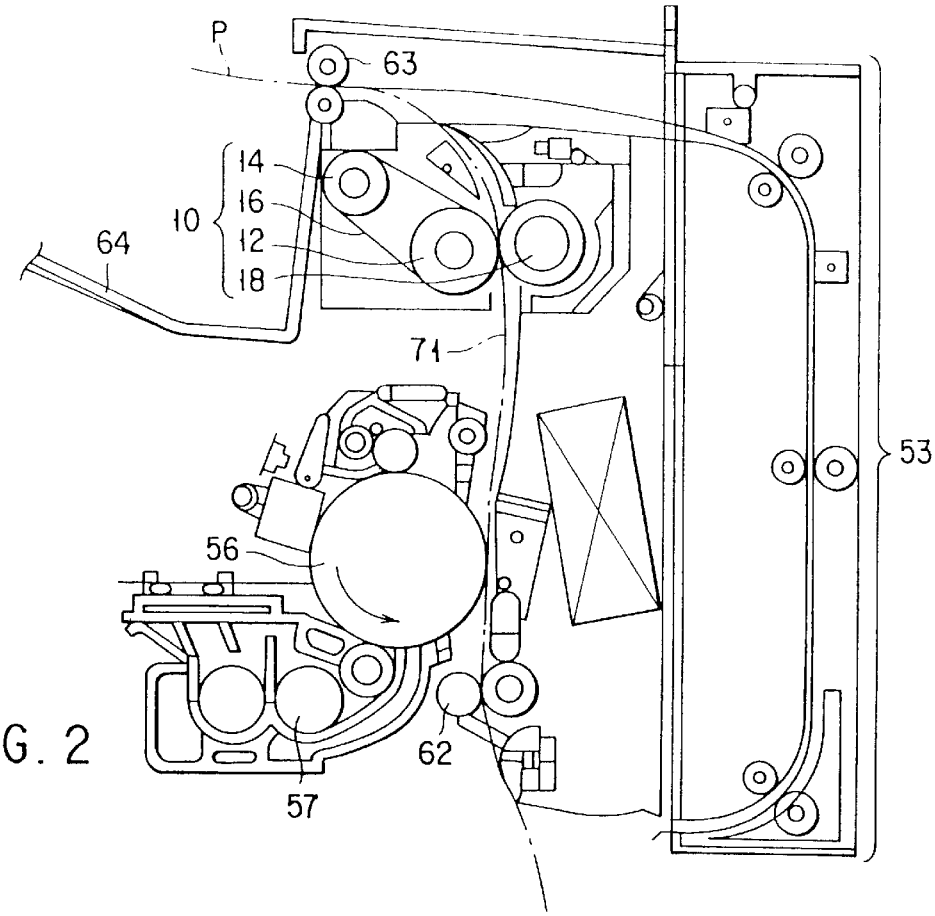
FIG. 2 is a perspective sectional view showing internal structures of a heating mechanism and peripheral units.

As shown in FIG. 1, a digital copier (image forming apparatus) 51 comprises an image reading unit (scanner) 52, which catches an image of an object as brightness and darkness of light and converts photoelectricaly to generate an image signal and an image forming portion 53, which forms an image corresponding to the image signal supplied from the scanner 52 or outside and fixes it onto a paper P which is a fixing object member (transfer member). Meanwhile, the scanner 52 is provided with an automatic draft paper feeding unit (ADF) 54 integratedly, which changes over draft papers successively interlockingly with image reading operation of the scanner 52, when the copying object is a sheet.

The image forming portion 53 comprises an exposure unit 55, a photosensitive drum 56, a developing unit 57 and a heating mechanism 10. The exposure unit 55 has a light source for irradiating with laser beam corresponding to image information supplied from the scanner 52 or an external unit. The photosensitive drum 56 has an outer circumferential face for holding a latent image as image information corresponding to laser beam from the exposure unit 55. The developing unit 57 is provided with a developing roller for developing an image by supplying toner to an image formed on the photosensitive drum 56.

The heating mechanism 10 has three rollers 12, 14 and 18 and a belt 16 for transferring a toner image developed by the developing unit 57 onto a paper P, melting it by heat and further applying a pressure.

In such image forming apparatus 51, a draft image is copied in a following manner. If an image signal is supplied from the scanner 52 or an external apparatus (not shown), the photosensitive drum 56 charged with electric charge is irradiated with laser beam (not shown) whose intensity is modulated corresponding to an image signal from the exposure unit 55. Consequently, an electrostatic latent image corresponding to an image to be copied (outputted) is formed on the photosensitive drum 56. Then, toner is supplied from the developing unit 57 to this electrostatic latent image so as to form a toner image.

The paper P is picked up one by one from a cassette 59 by a pick-up roller 60 and carried along a transportation aisle 61 between the photosensitive drum 56 and the cassette 59. Then, after timing between the toner image on the photosensitive drum 56 and the paper P is matched by an aligning roller 62, the toner image is transferred to the paper P by a transfer unit.

Further, the paper P is carried vertically from the transfer unit to the heating mechanism 10 along a paper transporting path 71. The heating mechanism 10 melts toner on the toner image on the paper P by heat and applies a pressure thereon so as to fix it on the paper P. The paper P is discharged to a discharged paper tray 64 from the heating mechanism 10 by a discharge roller 63.

First Embodiment

Next, a first embodiment of the present invention will be described with reference to FIGS. 2 to 5.

The heating mechanism 10 is provided along a paper transporting path 71 between a photosensitive drum 56 and a discharge roller 63 and comprises a fixing roller 12, a heating roller 14, an endless heat transferring belt 16, a pressurizing roller 18 and first/second restricting members 15 and 13. The fixing roller 12 and the pressurizing roller 18 are provided so as to oppose each other across the paper transporting path 71.

A shaft 12*a* of the fixing roller 12 is connected to a driving shaft of a motor (not shown) and a shaft 18a of the pressurizing roller 18 is connected to a driving shaft of another motor (not shown). Both the driving motors are controlled by a control unit (not shown) so that the rollers 12 and 18 rotationally drive synchronously. Further, a shaft 14*a* of the heating roller 14 is rotatably supported Consequently, the heating roller 14 is rotated according to the rotation of the fixing roller 12 through the heat transferring belt 16.

The heat transferring belt 16 is stretched between the fixing roller 12 and the heating roller 14. The heat transferring belt 16 is provided with heat energy from the heating roller 14 and makes contact with a paper P passing between the fixing roller 12 and the pressurizing roller 18 so as to melt toner on the toner image by heat. The heat transferring belt 16 is made of laminated composite material in which heat resistant silicone rubber and fluoroethylene based resin are layered successively on a nickel substrate. As the fluoroethylene based resin, for example, tetrafluoroethylene-perfluoroalkyl vinyl ether copolymer (PFA) is employed. The width $L_B$ of the belt 16 is preferred to be in a range of from 280 to 320 mm while the circumference length of the belt 16 is 70±5 mm.

In the fixing roller 12, its core is made of metal and its outer circumferential face is made of sponge-like soft heat resistant resin. An elastic outer circumferential face of the roller 12 is coated with silicone rubber or flour rubber. The diameter of the roller 12 is 37 to 38 mm.

In the heating roller 14, both its core and outer circumferential face are made of heat resistant and abrasion resistant metal. The heating roller 14 is made of, for example, pure iron, stainless steel, aluminum, an alloy of stainless steel and aluminum or the like. This roller 14 all made of metal incorporates a heater (its maximum heating capacity is 250° C.). The heat transferring belt 16 is heated at temperatures of 170° C. to 220° C. by this heater. The diameter of the heating roller 14 is 30 to 40 mm. The temperature of at least one of the heat transferring belt 16 and the rollers 12 and 14 is detected by a temperature sensor (not shown) and a power supply of the heater is feed-back controlled by a controller unit (not shown) based on that detected temperature.

In the pressurizing roller 18, its core is made of metal and its outer circumferential face is made of fluoroethylene based resin, for example, tetrafluoroethylene-perfluoroalkyl vinyl ether copolymer (PFA). The diameter of the pressurizing roller 18 is 38 to 42 mm.

Figure 3:
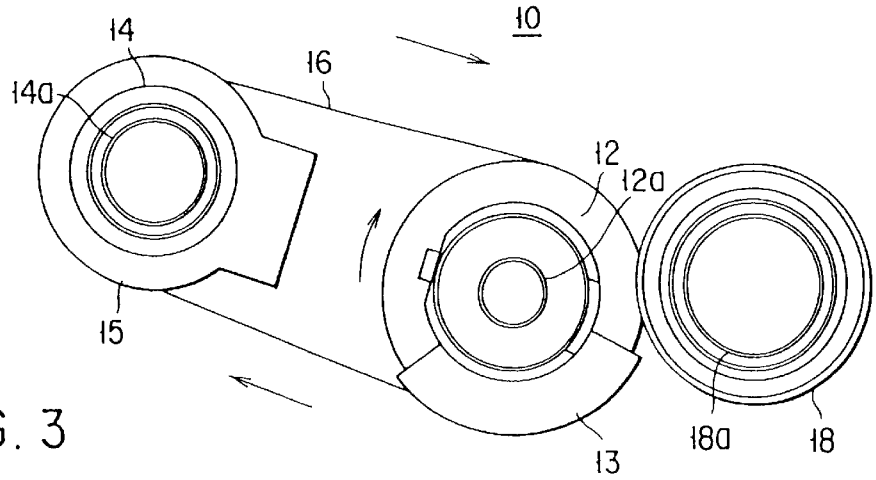
FIG. 3 is a sectional view of major parts of a heating mechanism according to a first embodiment of the present invention.
Figure 4:
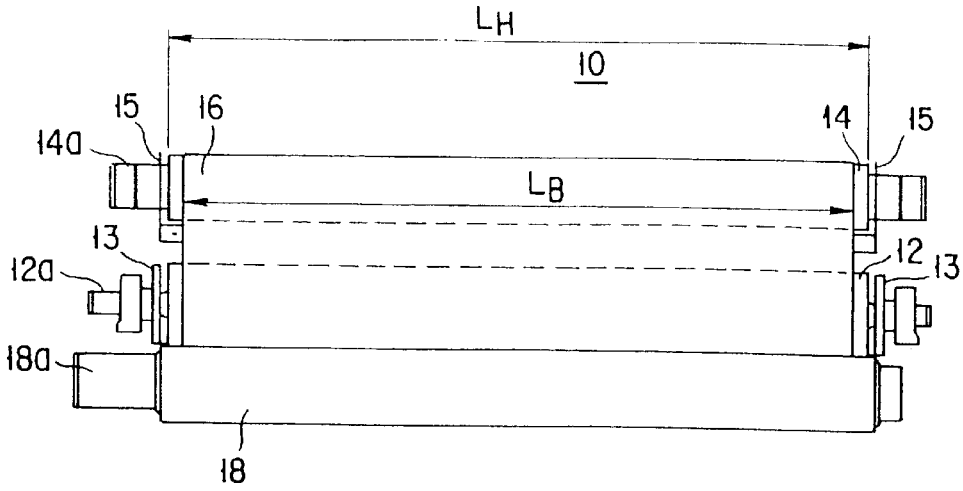
FIG. 4 is a plan view showing the heating mechanism of the first embodiment.
Figure 5:
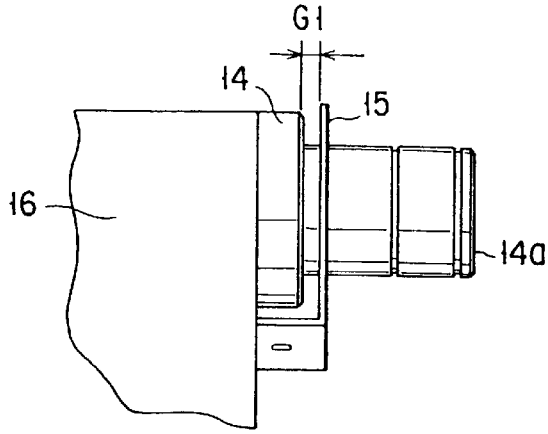
FIG. 5 is an enlarged view showing part of the heating mechanism of the first embodiment.
Figure 6:
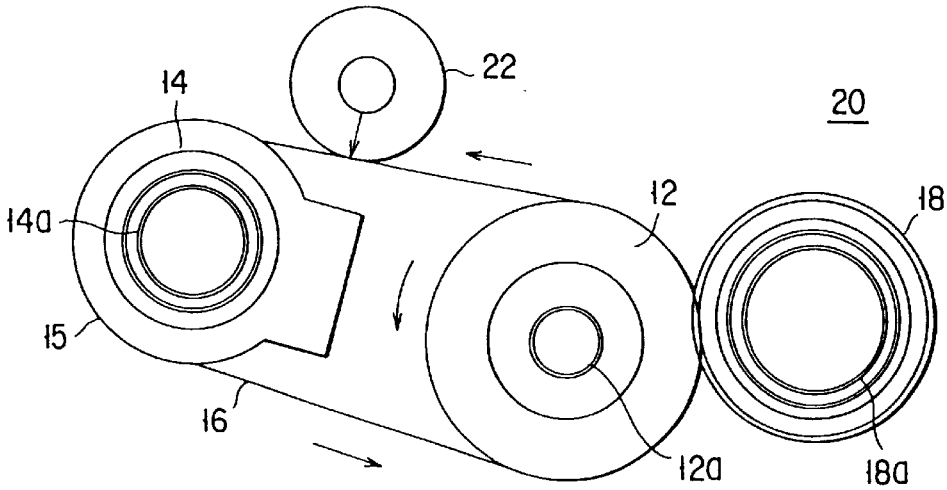
FIG. 6 is a sectional view of major parts of a heating mechanism according to a second embodiment of the present invention.
Figure 7:
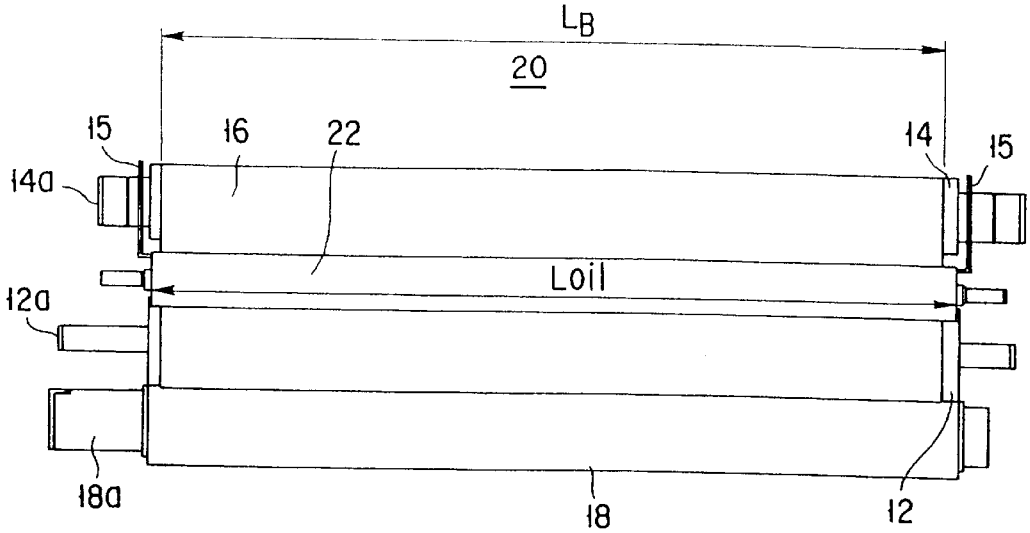
FIG. 7 is a plan view showing the heating mechanism of the second embodiment.
Figure 8A:
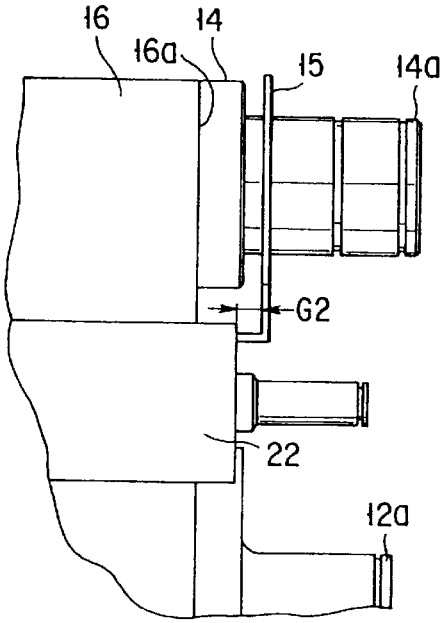
FIG. 8A and 8B are enlarged views showing part of the heating mechanism of the second embodiment.
Figure 8B:
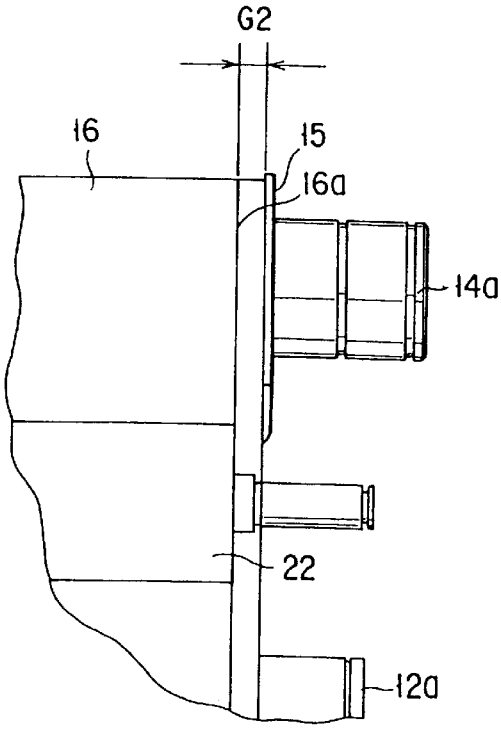

As shown in FIG. 3, the first restricting members 15 are mounted on both sides of the heating roller 14 so as to restrict the belt 16 from shifting in the width direction on the heating roller 14. Further, the second restricting members 13 are mounted on both sides of the fixing roller 12 so as to restrict the belt 16 from shifting in the width direction on the fixing roller 12. Meanwhile the first restricting member 15 and the second restricting member 13 need to be disposed in the same phase.

The fixing roller 12 is rotationally driven by a driving motor (not shown) and the heating roller 14 is rotated according to the rotation of the heating roller through the belt 16. For the reason, a shift force hereinafter referred to as a belt shifting force in the width direction of the belt 16 is relatively small on the side of the heating roller 14, while the belt shifting force is larger on the side of the fixing roller 12.

Next, such an advantage by providing not only the first restricting member 15 on the side of the heating roller 14 but also the second restricting member 13 on the side of the fixing roller 12 will be described.

In the heating mechanism having only the first restricting member 15, when the belt shifting force increases, a belt side portion 16*a* is pressed against the restricting member 15 strongly, so that the belt side portion 16*a* may be buckled. However, by providing the second restricting member 13 on the side of the fixing roller 12, the total length of the first and second restricting members 13 and 15 which the belt side portion 16*a* makes a sliding contact increases, so that a local stress concentration at the belt side portion 16*a* is relaxed, thereby the belt side portion 16*a* is not buckled.

In this case, while the first restricting member 15 is provided on substantially a half circumference ($\pi D/2$) of the roller 14, the second restricting member 13 is provided on substantially a ⅓ the entire circumference ($\pi D/3$) of the roller 12. The second restricting member 13 is disposed on the side in which the belt 16 is fed out of the roller 12. Because at this place, the tension of the belt 16 drops and the belt shifting force increases, the belt side portion 16*a* is likely to slip out of the roller 12. Such slip-out of the belt side portion 16*a* is blocked by the second restricting member 13 so as to prevent the belt side portion 16*a* from being buckled.

The inventors examined whether or not the buckling occurs in the belt side portion 16*a* by changing a gap G1 between an end face of the heating roller 14 and the first restricting member 15. As a result, it is found that if the first restricting member 15 is disposed so that the gap G1 is not more than 1.5 mm, the belt side portion 16*a* is not buckled.

Additionally, the inventors have noticed that when the width $L_B$ of the belt 16 is larger than the length $L_H$ of the fixing roller 12 and the heating roller 14, the local stress concentration occurs in the belt 16 at end portions of the rollers 12 and 14, thereby the belt side portion 16*a* is buckled. Thus, by making the width $L_B$ of the belt 16 shorter than the length $L_H$ of the fixing roller 12 and the heating roller 14, occurrence of the buckling of the belt side portion 16*a* is eliminated.

Second Embodiment

Next, the second embodiment of the present invention will be described with reference to FIGS. 6, 7, 8A, 8B, 9A, 9B and 9C. Meanwhile, a description of the same components as the above-described FIG. 1 is omitted.

A heating mechanism 20 comprises a fixing roller 12, a heating roller 14, an endless heat transferring belt 16, a pressurizing roller 18, a first restricting member 15 and a release agent roller 22.

The release agent roller 22 is constituted so as to be supplied with oil from a supply source (not shown) in order to coat the heat transferring belt 16 with oil. Further, the release agent roller 22 is pressed against the heat transferring belt 16 across the entire belt width $L_B$ of the belt by pressing means (not shown) in order to apply an additional tension to the heat transferring belt 16 so that it is freely rotatable. The release agent roller 22 is disposed on the side in which the belt 16 is fed out of the fixing roller 12 (loose side). Further, the release agent roller 22 is located nearer the heating roller 14 than the fixing roller 12.

The length $L_{oil}$ of the release agent roller 22 is longer than the width $L_B$ of the belt 16. If the length $L_{oil}$ of the release agent roller 22 is shorter than the width $L_B$ of the belt 16, a tension short region is generated in the belt side portion 16*a*, so that the belt 16 is likely to occur. Particularly, when the heat transferring belt 16 shifts in the width direction, deviation of the heat transferring belt 16 from the rollers 12 and 14 increases and then, if a paper P is passed with this condition, a belt side portion 16*a* in a sliding contact with the restricting member 15 is swollen, thereby the belt 16 being damaged.

The inventors examined whether or not the buckling occurred in the belt side portion 16*a* by changing a gap G2 between an end face of the release agent roller 22 and the first restricting member 15. As a result, it has been confirmed that no buckling occurs in the belt side portion 16*a* when the gap G2 is 7 mm while it is unlikely that the buckling occurs in the belt side portion 16*a* when the gap G2 is not more than 12 mm. That is, even if the belt 16 shifts from its normal position shown in FIG. 9A to an abnormal position shown in FIG. 9B, no deformation occurs in the belt side portion 16*a* and the belt side portion 16*a* comes into a sliding contact with the first restricting member 15. Thus, the belt side portion 16*a* is never buckled and a motion in the width direction of the belt 16 is restricted.

Figure 9A:
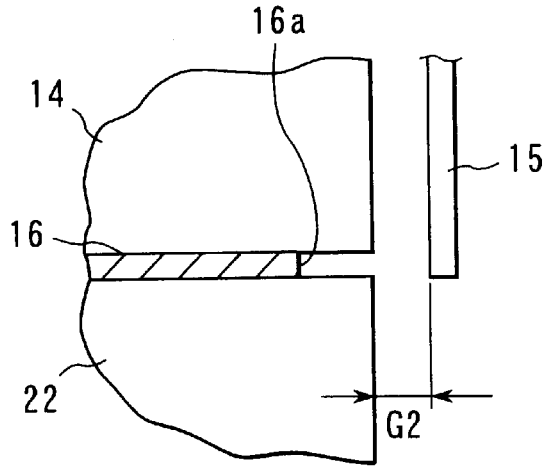
FIG. 9A and 9B are partial sectional views showing the major parts of the heating mechanism according to the second embodiment and FIG. 9C is a partial sectional view showing a heating mechanism as a comparative example.
Figure 9B:
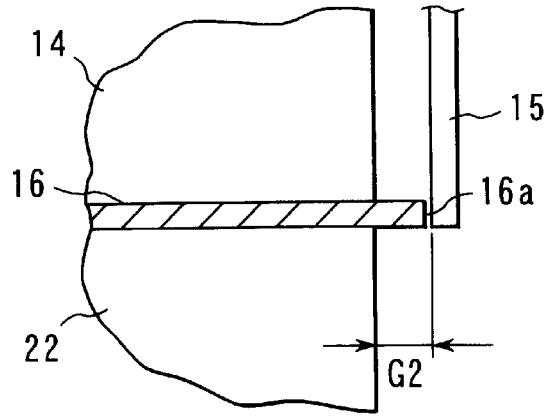
Figure 9C:
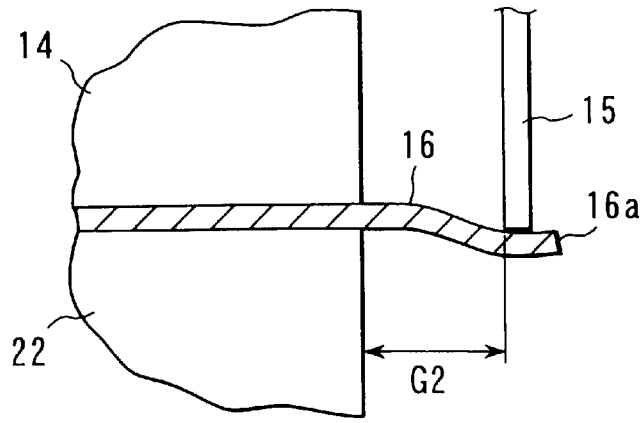

On the other hand, if the gap G2 exceeds 12 mm, the belt side portion 16*a* is swollen a s shown in FIG. 9C, so that the belt side portion 16*a* is buckled and consequently, the belt 16 is broken in a short period.

Because according to the present invention, the belt does not shift largely in the width direction, no unfixed image is generated and all toner images in the image forming region can be fixed securely on the paper.

Further, because according to the present invention, the buckling or swelling (out-of-plane deformation) of the belt is eliminated, the rotational driving of the belt is stabilized, thereby substantially extending the service life of the belt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heating mechanism for use in an image forming apparatus, comprising:

a paper transporting path for carrying a paper having a toner image;

a fixing roller disposed in the paper transporting path so that it is rotationally driven;

a pressurizing roller disposed so as to oppose said fixing roller across said paper transporting path so that it contacts one side face of a paper carried on said paper transporting path, said pressurizing roller being rotated synchronously with said fixing roller for applying a pressure on said paper in cooperation with said fixing roller;

a heating roller provided apart from said fixing roller for applying heat indirectly to said fixing roller;

a heat transferring belt which is wound around said heating roller and said fixing roller in order to transmit a rotation driving force from said fixing roller to said heating roller and thermal energy from said heating roller to said fixing roller, makes a contact with the other side face of the paper passing between said fixing roller and said pressurizing roller, and melts toner on said toner image by heat to fix said toner image to the paper;

a pair of first restricting members disposed and fitted with a predetermined gap G1 from both end faces of said heating roller to guard both sides of said heat transferring belt on said heating roller thereby restricting a shifting motion of said heat transferring belt in the width direction; and a pair of second restricting members disposed and fitted with a predetermined gap from both end faces of said fixing roller to guard both sides of said heat transferring belt on said fixing roller, thereby restricting a shifting motion of said heat transferring belt in the width direction.

2. A heating mechanism in an image forming apparatus according to claim 1, wherein said first restricting members are disposed on the side in which said heat transferring belt is fed from said heating roller.

3. A heating mechanism in an image forming apparatus according to claim 1, wherein said second restricting members are disposed on the side in which said heat transferring belt is fed from said fixing roller.

4. A heating mechanism in an image forming apparatus according to claim 1, wherein each of said first restricting members is disposed along a half circumference of the heating roller and on the side in which the belt is fed out of the heating roller, and the gap G1 in plan view from a respective end face of said heating roller to said first restricting members is not more than 1.5 mm.

5. A heating mechanism in an image forming apparatus according to claim 1, wherein a width $L_B$ of the heat transferring belt is smaller than a length $L_H$ of the heating roller and smaller than a length of said fixing roller.

6. A heating mechanism in an image forming apparatus according to claim 1, wherein said fixing roller is provided above a developing unit for forming said toner image on a paper, and said paper transporting path is extended vertically from said developing unit located below to said fixing roller located above.

7. A heating mechanism for use in an image forming apparatus, comprising:

a paper transporting path for carrying a paper having a toner image;

a fixing roller disposed in the paper transporting path so that it is rotationally driven;

a pressurizing roller disposed so as to oppose said fixing roller across said paper transporting path so that it contacts one side face of a paper carried on said paper transporting path, said pressurizing roller being rotated synchronously with said fixing roller for applying a pressure on said paper in cooperation with said fixing roller, a heating roller provided apart from said fixing roller for applying heat indirectly to said fixing roller, a heat transferring belt which is wound around said heating roller and said fixing roller in order to transmit a rotation driving force from said fixing roller to said heating roller and thermal energy from said heating roller to said fixing roller, makes a contact with the other side face of the paper passing between said fixing roller and said pressurizing roller, and melts toner on said toner image by heat to fix said toner image to the paper, a pair of first restricting members disposed and fitted with a predetermined gap G1 from both end faces of said heating roller to guard both sides of said heat transferring belt on said heating roller thereby restricting a shifting motion of said heat transferring belt in the width direction, and a release agent roller which coats said heat transferring belt with a release agent and is pressed on an entire width $L_B$ of said heat transferring belt so as to apply a tension to said heat transferring belt, wherein a gap G2 in plan view from a respective end face of said release agent roller to said first restricting members is not more than 12 mm.

8. A heating mechanism in an image forming apparatus according to claim 7, wherein a length $L_{oil}$ of said release agent is longer than the entire width $L_B$ of said heat transferring belt.

9. A heating mechanism in an image forming apparatus according to claim 7, wherein a gap G2 in plan view from a respective end face of said release agent roller to said first restricting members is not more than 7 mm.

10. A heating mechanism for use in an image forming apparatus, comprising:

a paper transporting path for carrying a paper having a toner image;

a fixing roller disposed in the paper transporting path so that it is rotationally driven, a pressurizing roller disposed so as to oppose said fixing roller across said paper transporting path so that it contacts one side face of a paper carried on said paper transporting path, said pressurizing roller being rotated synchronously with said fixing roller for applying a pressure on said paper in cooperation with said fixing roller;

a heating roller provided apart from said fixing roller for applying heat indirectly to said fixing roller;

a heat transferring belt which is wound around said heating roller and said fixing roller in order to transmit a rotation driving force from said fixing roller to said heating roller and thermal energy from said heating roller to said fixing roller, makes a contact with the other side face of the paper passing between said fixing roller and said pressurizing roller, and melts toner on said toner image by heat to fix said toner image to the paper, a pair of first restricting members disposed and fitted with a predetermined gap F1 from both end faces of said heating roller to guard both sides of said heat transferring belt on said heating roller thereby restricting a shifting motion of said heat transferring belt in the width direction, and a tension roller which is pressed on an entire width $L_B$ of said heat transferring belt for applying a tension to said heat transferring belt, wherein a gap G2 in plan view from a respective end face of said tension roller to said first restricting members is not more than 12 mm.

* * * * *